US010193242B2

(12) United States Patent
Oberski

(10) Patent No.: US 10,193,242 B2
(45) **Date of Patent: *Jan. 29, 2019**

(54) PRINTED CIRCUIT BOARD BASED COMMUNICATIONS PLUGS THAT ARE SUITABLE FOR FIELD TERMINATION AND PATCH CORDS INCLUDING SUCH PLUGS

(71) Applicant: CommScope, Inc. of North Carolina, Hickory, NC (US)

(72) Inventor: Jeffrey A. Oberski, Lucas, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/831,557

(22) Filed: Dec. 5, 2017

(65) Prior Publication Data

US 2018/0097297 A1 Apr. 5, 2018

Related U.S. Application Data

(63) Continuation of application No. 15/207,735, filed on Jul. 12, 2016, now Pat. No. 9,853,369.

(60) Provisional application No. 62/198,767, filed on Jul. 30, 2015.

(51) Int. Cl.

| | |
|---|---|
| ***H01R 4/26*** | (2006.01) |
| ***H01R 4/2404*** | (2018.01) |
| ***H01R 13/66*** | (2006.01) |

(52) U.S. Cl.
CPC ..... *H01R 4/2404* (2013.01); *H01R 13/6658* (2013.01)

(58) Field of Classification Search
CPC . H01R 23/025; H01R 4/2404; H01R 13/6658
USPC ..... 439/404, 405, 418, 425, 676
See application file for complete search history.

(56) References Cited

U.S. PATENT DOCUMENTS

| | | | |
|---|---|---|---|
| 5,967,801 | A | 10/1999 | Martin et al. |
| 6,193,526 | B1 | 2/2001 | Milner et al. |
| 6,447,326 | B1 | 9/2002 | Teach et al. |
| 7,857,635 | B2 | 12/2010 | Goodrich et al. |
| 8,197,286 | B2 | 6/2012 | Larsen et al. |
| 8,257,117 | B2 | 9/2012 | Pepe et al. |
| 8,690,598 | B2 | 4/2014 | Bolouri-Saransar et al. |
| 8,864,532 | B2 | 10/2014 | Larsen et al. |
| 8,920,199 | B2 | 12/2014 | Schumacher et al. |
| 9,853,369 | B2 * | 12/2017 | Oberski ..... H01R 4/2404 |
| 2014/0273629 | A1 | 9/2014 | Canning et al. |

* cited by examiner

*Primary Examiner* — Khiem Nguyen
(74) *Attorney, Agent, or Firm* — Myers Bigel, P.A.

(57) ABSTRACT

A communications plug includes a housing, a printed circuit board that is at least partially within the housing, first through eighth plug contacts mounted adjacent a front edge of the printed circuit board, and first through eighth wire connection terminals having insulation cutting blades, where at least some of the insulation cutting blades are mounted rearwardly of a rear edge of the printed circuit board.

18 Claims, 7 Drawing Sheets

PRINTED CIRCUIT BOARD BASED COMMUNICATIONS PLUGS THAT ARE SUITABLE FOR FIELD TERMINATION AND PATCH CORDS INCLUDING SUCH PLUGS

CROSS-REFERENCE TO RELATED APPLICATION

The present application is a continuation of U.S. patent application Ser. No. 15/207,735; filed Jul. 12, 2016, which claims priority under 35 U.S.C. § 119 from U.S. Provisional Patent Application Ser. No. 62/198,767, filed Jul. 30, 2015, the entire contents of which are incorporated herein by reference as if set forth fully herein.

FIELD OF THE INVENTION

The present invention relates generally to communications patch cords and, more particularly, to patch cords having plugs that can be terminated in the field.

BACKGROUND

Many hardwired communications systems use plug and jack connectors to connect a communications cable to another communications cable or to computer equipment. By way of example, high speed communications systems routinely use such plug and jack connectors to connect computers, printers and other devices to local area networks and/or to external networks such as the Internet. FIG. 1 depicts a highly simplified example of such a hardwired high speed communications system that illustrates how plug and jack connectors may be used to interconnect a computer 11 to, for example, a network server 20.

As shown in FIG. 1, the computer 11 is connected by a cable 12 to a communications jack 15 that is mounted in a wall plate 19. The cable 12 is a patch cord that includes a communications plug 13, 14 at either end thereof. Typically, the cable 12 includes eight insulated conductors. As shown in FIG. 1, plug 14 is inserted into an opening or "plug aperture" 16 in the front side of the communications jack 15 so that the contacts or "plug blades" of communications plug 14 mate with respective contacts of the communications jack 15. If the cable 12 includes eight conductors, the communications plug 14 and the communications jack 15 will typically each have eight contacts. The communications jack 15 includes a wire connection assembly 17 at the back end thereof that receives a plurality of conductors (e.g., eight) from a second cable 18 that are individually pressed into slots in the wire connection assembly 17 to establish mechanical and electrical connections between each conductor of the second cable 18 and a respective one of the conductive paths through the communications jack 15. The other end of the second cable 18 is connected to, for example, a network server 20 which may be located, for example, in a telecommunications closet of a commercial office building. Communications plug 13 similarly is inserted into the plug aperture of a second communications jack (not pictured in FIG. 1) that is provided in the back of the computer 11. Thus, the patch cord 12, the cable 18 and the communications jack 15 provide a plurality of electrical paths between the computer 11 and the network server 20. These electrical paths may be used to communicate information signals between the computer 11 and the network server 20. While not shown in FIG. 1 to simplify the drawing, typically additional equipment (e.g., patch panels, network switches, etc.), patch cords and cables are interposed between cable 18 and network server 20.

When a signal is transmitted over a conductor (e.g., an insulated copper wire) of a communications cable, electrical noise from external sources may be picked up by the conductor, degrading the quality of the signal. In order to counteract such noise sources, the information signals in the above-described communications systems are typically transmitted between devices over a pair of conductors (hereinafter a "differential pair" or simply a "pair") rather than over a single conductor using differential signaling techniques. The two conductors of each differential pair are twisted tightly together in the communications cables and patch cords so that the eight conductors are arranged as four twisted differential pairs of conductors. The signals transmitted on each conductor of a differential pair have equal magnitudes, but opposite phases, and the information signal is embedded as the voltage difference between the signals carried on the two conductors of the pair. When an information signal is transmitted using differential signaling techniques over a twisted differential pair of conductors, each conductor in the differential pair often picks up approximately the same amount of noise from these external sources. Because the information signal is extracted by taking the difference of the signals carried on the two conductors of the differential pair, the subtraction process may mostly cancel out the noise signal, and hence the information signal is typically not disturbed.

Referring again to FIG. 1, it can be seen that a series of plugs, jacks and cable segments connect the computer 11 to the server 20. Each plug, jack and cable segment includes four differential pairs, and thus a total of four differential transmission lines are provided between the computer 11 and the server 20 that may be used to carry two way communications therebetween (e.g., two of the differential pairs may be used to carry signals from the computer 11 to the server 20, while the other two differential pairs may be used to carry signals from the server 20 to the computer 11). Unfortunately, the proximities of the conductors and contacting structures of the four differential pairs within each plug-jack connection (e.g., where plug 14 mates with jack 15) can produce capacitive and/or inductive couplings between the conductors/contacts of different differential pairs. These capacitive and inductive couplings in the connectors (and similar couplings that may arise in the cabling) give rise to another type of noise that is known as "crosstalk."

In particular, "crosstalk" refers to unwanted signal energy that is capacitively and/or inductively coupled onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal that is transmitted over the victim differential pair.

While methods are available that can significantly reduce the effects of crosstalk in communications systems, the connector configurations that were adopted years ago—and which still are in effect in order to maintain backwards compatibility—generally did not arrange the connector contact structures so as to minimize crosstalk between the differential pairs in the connector hardware. For example, pursuant to the ANSI/TIA-568-C.2 standard approved Aug. 11, 2009 by the Telecommunications Industry Association, in the connection region where the contacts of a modular plug mate with the contacts of the modular jack (referred to herein as the "plug-jack mating region"), the eight contacts 1-8 of the jack must be aligned in a row, with the eight contacts 1-8 of the jack arranged as four differential pairs specified as depicted in FIG. 2. As known to those of skill in the art, under the TIA/EIA 568 type B configuration, contacts 4 and 5 in FIG. 2 comprise pair 1, contacts 1 and 2 comprise pair 2, contacts 3 and 6 comprise pair 3, and contacts 7 and 8 comprise pair 4. The eight plug blades of a mating plug are similarly aligned in a row so that they will mate with respective jack contacts 1-8. As is apparent from FIG. 2, this arrangement of the eight contacts 1-8 in the jack (and the similar arrangement of the eight corresponding blades of a mating plug) will result in unequal coupling between the differential pairs, and hence both NEXT and FEXT is introduced in each connector in industry standardized communications systems.

SUMMARY

Pursuant to embodiments of the present invention, communications plugs are provided that include a housing; a printed circuit board that is at least partially within the housing; first through eighth plug contacts mounted adjacent a front edge of the printed circuit board; and first through eighth wire connection terminals having insulation cutting blades, where at least some of the insulation cutting blades are mounted rearwardly of a rear edge of the printed circuit board.

In some embodiments, each wire connection terminal may be an insulation piercing contact that includes an insulation piercing portion that has the insulation cutting blades, a termination post that is mounted in the printed circuit board, and an extension that connects the insulation piercing portion to the termination post. The extensions for some of the insulation piercing contacts may extend longitudinally along a top face of the printed circuit board and the extensions for the remainder of the insulation piercing contacts may extend longitudinally along a bottom face of the printed circuit board.

In some embodiments, the plug may further include a wire guide that has a base, the base including a plurality of first channels arranged in a row along a front edge thereof. Each of the first channels may extend in a vertical direction that is perpendicular to a top face of the printed circuit board. The wire guide may further include a plurality of second channels that extend between a rear of the wire guide and the front edge of the base. Eight first channels may be provided and four second channels may be provided. A crosstail may extend rearwardly from the base.

In some embodiments, the plug may further include a contact holder mounted along the rear edge of the printed circuit board. The contact holder may include first through eighth vertical slots that each extend in a direction that is perpendicular to a top face of the printed circuit board. Each of the first through eighth wire connection terminals may extend rearwardly through a respective one of the first through eighth vertical slots. The contact holder may include first through eighth longitudinal slots that each extend in a longitudinal direction defined by a longitudinal axis of the printed circuit board, and each of the first through eighth wire connection terminals may include a longitudinal extension that is received within a respective one of the first through eighth longitudinal slots.

Pursuant to further embodiments of the present invention, communications plugs are provided that include a housing having a rear cap that has a cable aperture; a printed circuit board having a front edge, a rear edge, a top face and a bottom face, the printed circuit board mounted at least partially within the housing; a dielectric contact holder mounted on the rear edge of the printed circuit board; and a wire guide that includes a plurality of first channels mounted at least partly within the housing between the rear cap and the dielectric contact holder.

In some embodiments, the plug may further include a plurality of wire connection terminals that are electrically connected to respective conductive paths on the printed circuit board, where each of the wire connection terminals includes an insulation cutting blade that extends through the dielectric contact holder. The insulation cutting blades of the wire connection terminals may be mounted rearwardly of a rear edge of the printed circuit board. The wire connection terminals may be insulation piercing contacts that each include an insulation piercing portion that has the insulation cutting blade, a termination post that is mounted in the printed circuit board, and an extension that connects the insulation piercing portion to the termination post. The extensions for some of the insulation piercing contacts may extend along a top face of the printed circuit board and the extensions for the remainder of the insulation piercing contacts may extend along a bottom face of the printed circuit board.

In some embodiments, the first channels of the wire guide may be arranged in a row along a front edge thereof. Each of the first channels may extend in a vertical direction that is perpendicular to a top face of the printed circuit board. The wire guide may further include a plurality of second channels that extend between a rear of the wire guide and the front edge of the wire guide.

In some embodiments, the dielectric contact holder may include first through eighth vertical slots that each extend in a direction that is perpendicular to a top face of the printed circuit board, and each of the first through eighth wire connection terminals may extend rearwardly through a respective one of the first through eighth vertical slots. The dielectric contact holder may include first through eighth longitudinal slots that each extend in a longitudinal direction defined by a longitudinal axis of the printed circuit board, and each of the first through eighth wire connection terminals may include a longitudinal extension that is received within a respective one of the first through eighth longitudinal slots. The communications plug may be in combination with a communications cable that has a plurality of insulated conductors that are physically and electrically connected to the respective wire connection terminals to provide a communications patch cord.

Pursuant to still further embodiments of the present invention, patch cords are provided that include a communications cable that has a first conductor and a second conductor that are twisted together to form a second differential pair of conductors, a third conductor and a sixth conductor that are twisted together to form a third differential pair of conductors, a fourth conductor and a fifth conductor that are twisted together to form a first differential pair of conductors, and a seventh conductor and an eighth conductor that are twisted together to form a fourth differential pair of conductors and a communications plug. The plug may include a housing; a printed circuit board having a top face and a bottom face, the printed circuit board mounted at least partially within the housing; and first through eighth wire connection terminals that are electrically connected to the printed circuit board, each of the first through eighth wire connection terminals receiving a respective one of the first through eighth conductors. The ends of each of the first through eighth conductors extend in a vertical direction that is substantially normal to the top face of the printed circuit board.

In some embodiments, the plug may further include a wire guide, and the wire guide may include first through eighth vertical channels along a front edge thereof that receive the respective first through eighth conductors of the communications cable. The plug may also include a dielectric contact holder that is mounted on a rear edge of the printed circuit board, the dielectric contact holder including first through eighth semicircular vertical channels that mate with the first through eighth vertical channels of the wire guide.

In some embodiments, the ends of some of the first through eighth conductors may extend upwardly while the ends of the remainder of the first through eighth conductors may extend downwardly. Portions of the first through eighth wire connection terminals may extend rearwardly beyond a rear edge of the printed circuit board.

Pursuant to still other embodiments of the present invention, insulation piercing contacts are provided that include an insulation piercing portion that extends in a first direction and that has at least a first cutting blade that extends in a second direction; a termination post that extends in the first direction; and a longitudinal extension that extends in the second direction that connects the insulation piercing portion to the termination post.

In some embodiments, the second direction may be substantially perpendicular to the first direction. The termination post may comprise an eye-of-the-needle termination. The insulation piercing contact may be in combination with a printed circuit board having a top face, a bottom face, a front edge and a rear edge, where the insulation piercing portion of the insulation piercing contact is mounted to extend rearwardly from the rear edge of the printed circuit board. The termination post may extend downwardly from a first end portion of the longitudinal extension and the insulation piercing portion may extend downwardly from a second end portion of the longitudinal extension.

Pursuant to still further embodiments of the present invention, methods of terminating a communications cable into a communications plug are provided in which first through eighth wire connection terminals are mounted on a rear portion of a printed circuit board; a dielectric contact holder is mounted on the printed circuit board, the dielectric contact holder at least partially surrounding the wire connection terminals; the printed circuit board is mounted within a housing of the communications plug; first through eighth insulated conductors of the communications cable are terminated into a wire guide; and the wire guide is inserted into the housing to terminate the first through eighth insulated conductors into the respective first through eighth wire connection terminals.

DETAILED DESCRIPTION

Figure 1:
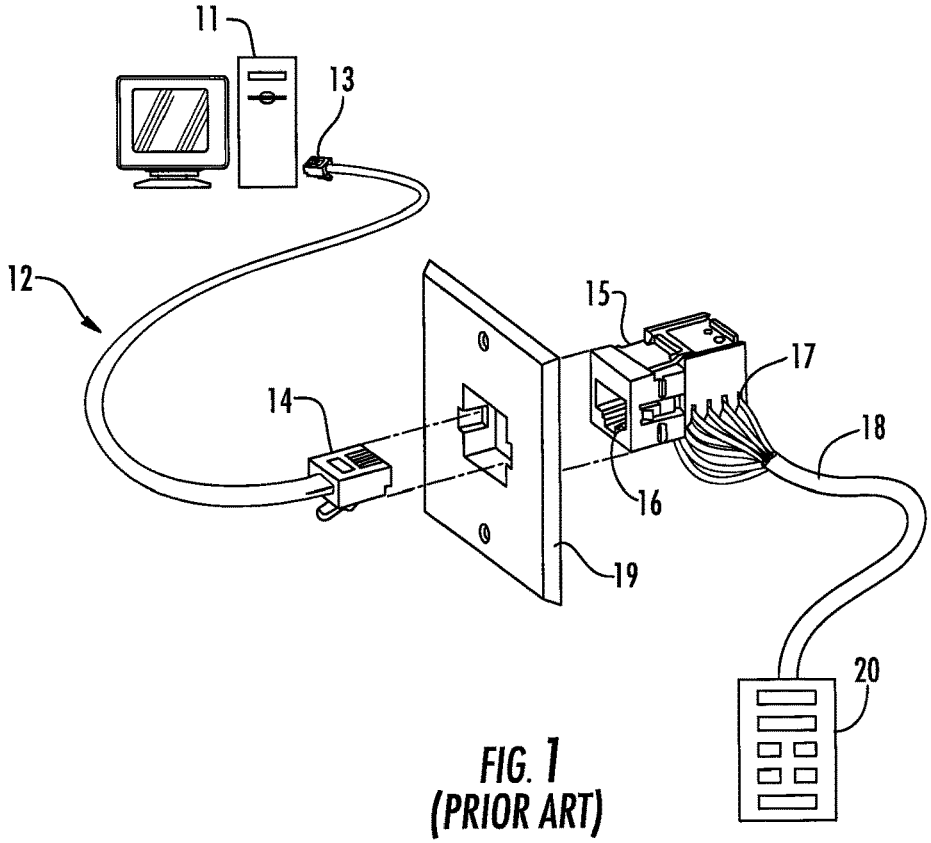
FIG. 1 (PRIOR ART)
FIG. 1 is a simplified schematic diagram illustrating the use of conventional communications plugs and jacks to interconnect a computer with a network server.
Figure 2:
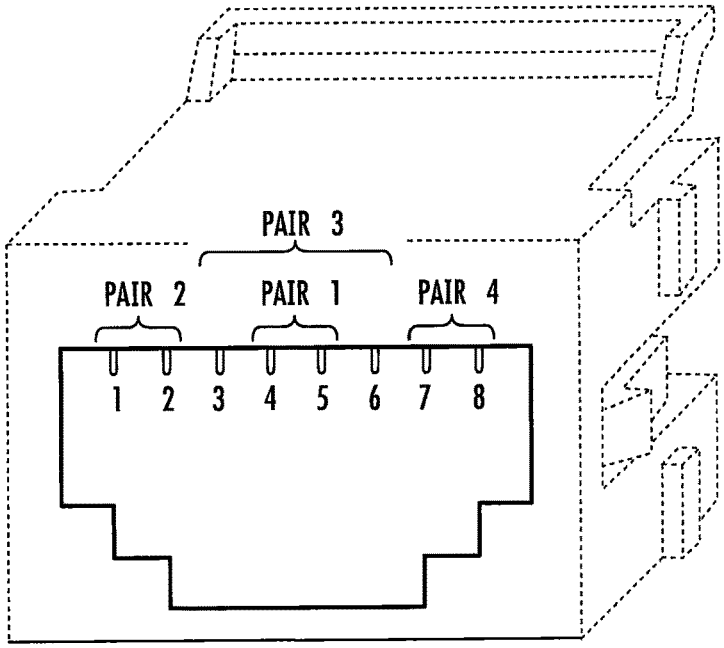
FIG. 2 (PRIOR ART)
FIG. 2 is a schematic diagram illustrating the modular jack contact wiring assignments for a conventional 8-position communications jack (TIA 568B) as viewed from the front opening of the jack.

The present invention is directed to printed circuit board based communications plugs which can be terminated onto a communications cable in the field to form a patch cord, as well as patch cords that include such plugs.

In some embodiments, the communications plugs may include wire connection terminals that extend rearwardly beyond a rear edge of the printed circuit board. The plugs may also include a wire guide, and the conductors of the communications cable may be mounted within channels in the wire guide. The wire guide may then be inserted into a housing of the plug, and the channels in the wire guide may be aligned with the wire connection terminals so that each conductor of the communications cable is terminated into a respective one of the wire connection terminals when the wire guide is locked into place within the plug housing.

In some embodiments, each of the wire connection terminals may include an insulation piercing portion that has one or more insulation cutting blades, a termination post, and an extension (typically a longitudinal extension) that connects the insulation piercing portion to the termination post. The insulation piercing portions may extend in a first direction and the insulation cutting blades may extend in a second direction that may be substantially perpendicular to the first direction. The termination posts may extend in the first direction, and may be mounted in respective metal-plated apertures in the printed circuit board. The extensions may extend in the second direction. This wire connection terminal design may allow each wire connection terminal to be mounted to extend rearwardly from a rear edge of the printed circuit board. The wire connection terminals may be insulation piercing contacts.

The plug may further include a contact holder that surrounds and supports the wire connection terminals. The contact holder may include a plurality of vertically extending channels, and the insulation cutting blades of each wire connection terminal may extend into a respective one of these channels of the contact holder. When the wire guide is inserted into the plug housing with the conductors of the communications cable mounted thereon, the conductors are captured in the respective channels in the contact holder and terminated onto the respective wire connection terminals. The communications plugs may comprise RJ-45 plugs.

Embodiments of the present invention will now be discussed in greater detail with reference to the drawings. Herein, when the communications plugs and patch cords according to embodiments of the present invention include multiple of the same elements such as, for example, wire connection terminals, the elements may be referred to individually by their full reference number (e.g., wire connection terminal 262-3) and may be referred to collectively by the first part of their reference numeral (e.g., the wire connection terminal 262).

As used herein, the terms "forward" and "front" and derivatives thereof refer to the direction defined by a vector extending from the center of the plug toward the portion of the plug that is first received within a plug aperture of a jack when the plug is mated with a jack. Conversely, the term "rearward" and derivatives thereof refer to the direction directly opposite the forward direction. The forward and rearward directions define the longitudinal dimension of the plug. The vectors extending from the center of the plug toward the respective sidewalls of the plug housing define the transverse dimension of the plug. The transverse dimension is normal to the longitudinal dimension. The vectors extending from the center of the plug toward the respective top and bottom walls of the plug housing (where the top wall of the plug housing is the wall that includes slots that expose the plug blades) define the vertical dimension of the plug. The vertical dimension of the plug is normal to both the longitudinal and transverse dimensions.

Figure 3:
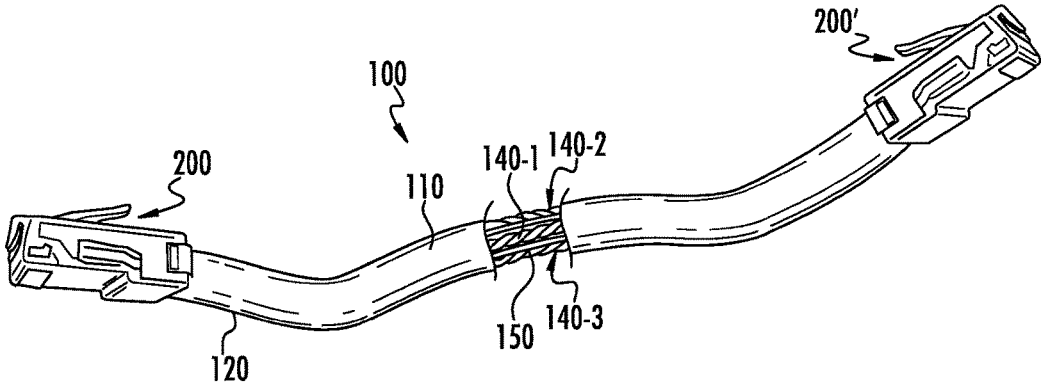
FIG. 3 is a perspective view of a patch cord according to certain embodiments of the present invention.

FIG. 3 is a perspective view of a patch cord 100 according to certain embodiments of the present invention. As shown in FIG. 3, the patch cord 100 includes a cable 110 that has eight insulated conductors 130-1 though 130-8 enclosed in a jacket 120 (the insulated conductors 130 are not individually numbered in FIG. 3 but are shown and numbered in FIGS. 12-13, and insulated conductors 130-7 and 130-8 are not visible in FIG. 3). The insulated conductors 130-1 though 130-8 may be arranged as four twisted differential pairs of conductors, with conductors 130-4 and 130-5 twisted together to form differential pair 140-1, conductors 130-1 and 130-2 twisted together to form differential pair 140-2, conductors 130-3 and 130-6 twisted together to form differential pair 140-3, and conductors 130-7 and 130-8 twisted together to form differential pair 140-4 (pair 140-4 is not visible in FIG. 3). Herein differential pairs 140-1, 140-2, 140-3 and 140-4 may be referred to simply as "pair 1," "pair 2," "pair 3" and "pair 4," respectively.

A separator 150 such as a cruciform separator or a separator tape may be provided that separates one or more of the twisted pairs 140-1 through 140-4 from one or more of the other two twisted pairs 140-1 through 140-4. A first plug 200 is attached to a first end of the cable 110 and a second plug 200' is attached to the second end of the cable 110 to form the patch cord 100. Strain relief features (not shown) may be attached to each of the plugs 200, 200' which resist the tendency for a longitudinal force applied to the cable 110 to pull the cable 110 out of the plugs 200, 200'.

Figure 4:
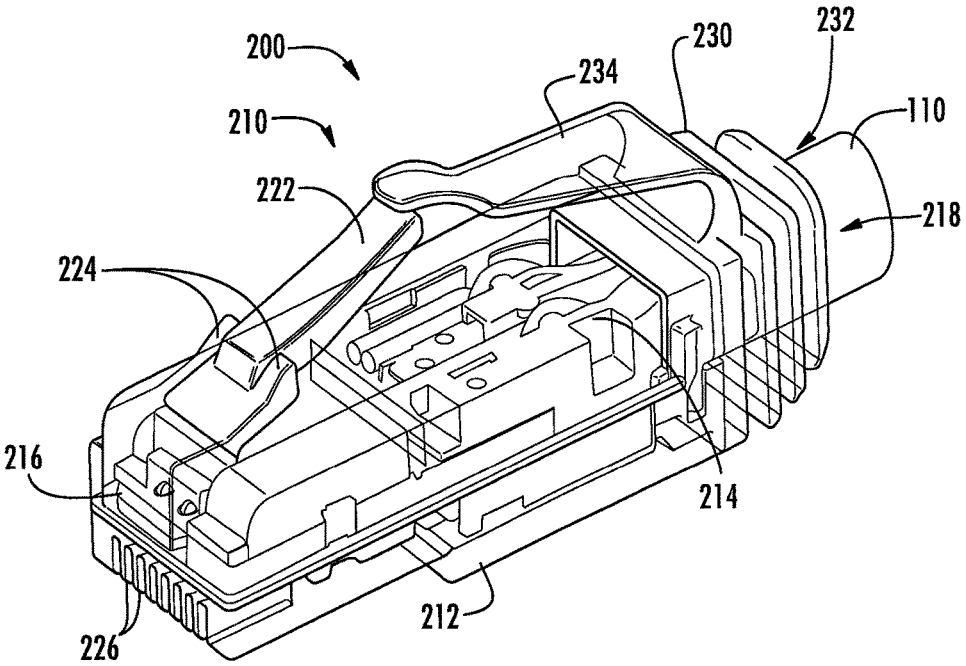
FIG. 4 is a front perspective view of a plug that is included on the patch cord of FIG. 3.

FIG. 4 is a bottom perspective view of the plug 200 of the patch cord 100. As shown in FIG. 4, the communications plug 200 includes a housing 210 that has a top surface 212, a bottom surface 214, a front surface 216, and a rear opening 218 that receives a rear cap 230. The housing 210 may be made of a suitable insulative plastic material that meets applicable standards with respect to, for example, electrical breakdown resistance and flammability such as, for example, polycarbonate, ABS, ABS/polycarbonate blend or other molded dielectric materials.

A plug latch 222 extends from the bottom surface 214 of the housing 210. As known to those of skill in the art, stops 224 that are included at the base of the plug latch 222 operate in conjunction with stops in a mating communications jack (not shown) to prevent the plug 200 from being removed from the communications jack once the plug 200 has been fully inserted therein. By applying an upwardly-directed force to the plug latch 222, the stops 224 may clear the corresponding stops in the communications jack, allowing the plug 200 to be removed from the communications jack.

A plurality of longitudinally extending slots 226 are provided along the front portion of the top surface 212 and these slots 226 extend onto the front surface 216 of the housing 210. The communications cable 110 is received through the rear opening 218. The rear cap 230 includes a cable aperture 232 that receives the cable 110, and the rear cap 230 locks into place within the rear opening 218 of housing 210 after the communications cable 110 has been inserted therein. The rear cap 23Q further includes a secondary latch 234 that extends forwardly to engage an underside of the plug latch 222. A technician can apply an upwardly-directed force to either the plug latch 222 or the secondary latch 234 to disengage the stops 224 from the mating stops in the communications jack so that the plug 200 can be removed therefrom.

Figure 5:
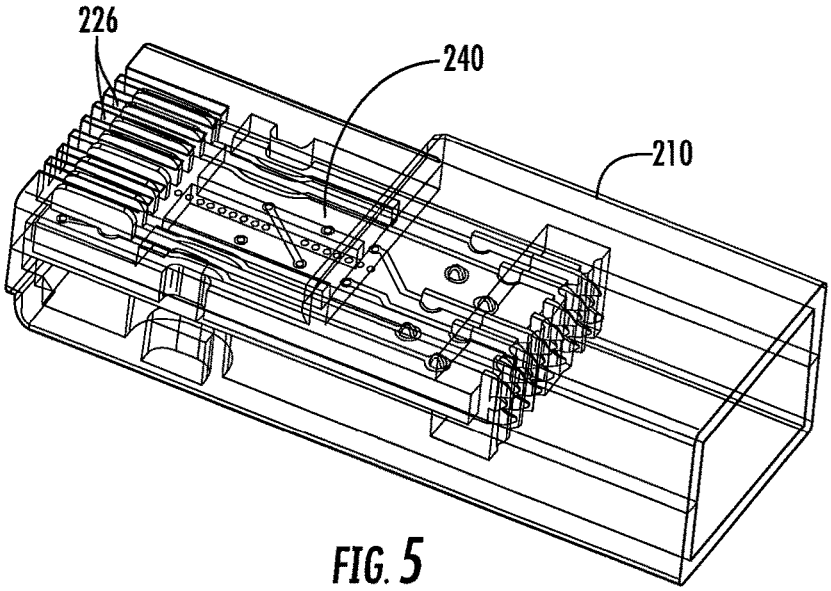
FIG. 5 is a top perspective view of portions of the housing of the plug of FIG. 4 illustrating how a printed circuit board is mounted therein.
Figure 6:
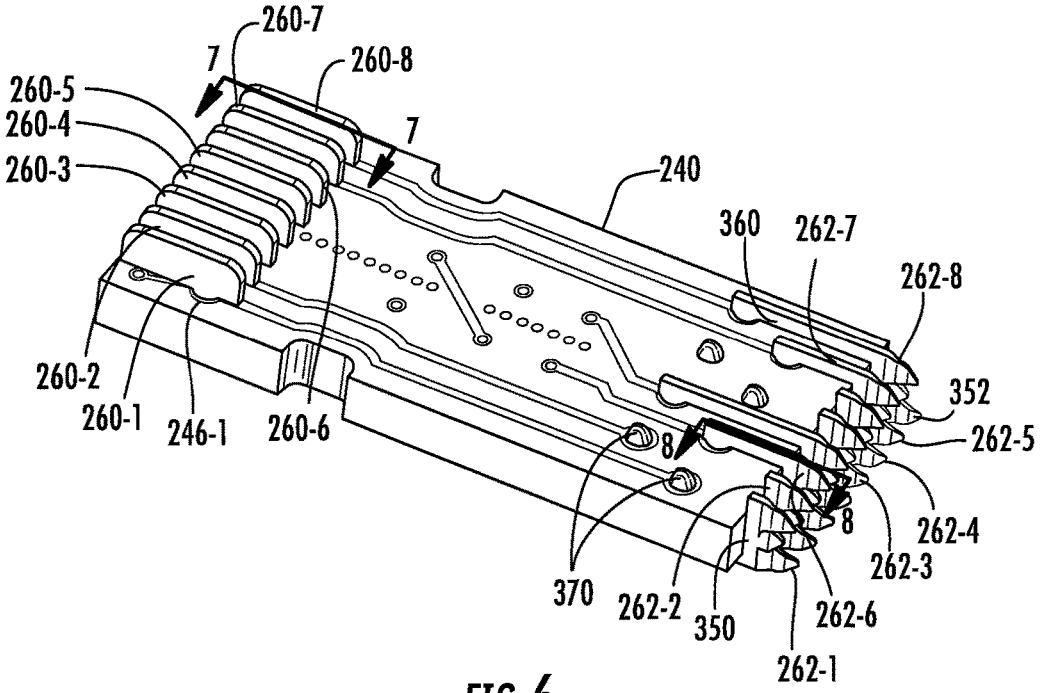
FIG. 6 is a top perspective view of the printed circuit board of FIG. 5 illustrating how eight plug blades and wire connection terminals are mounted thereon.
Figure 7:
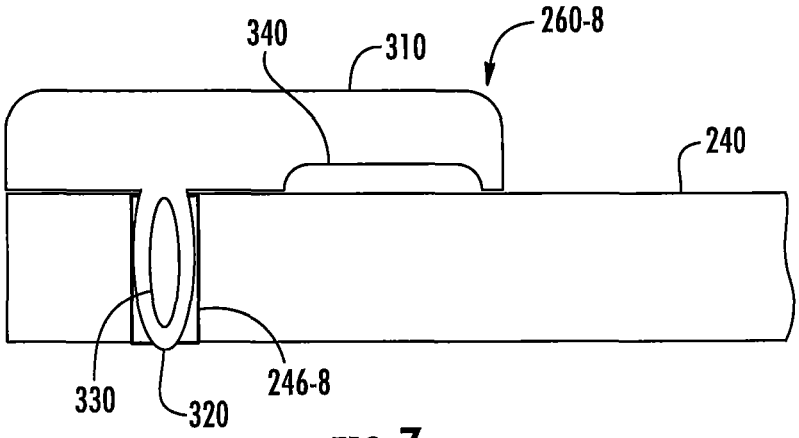
FIG. 7 is a schematic cross-sectional view taken along line 7-7 of FIG. 6.
Figure 8:
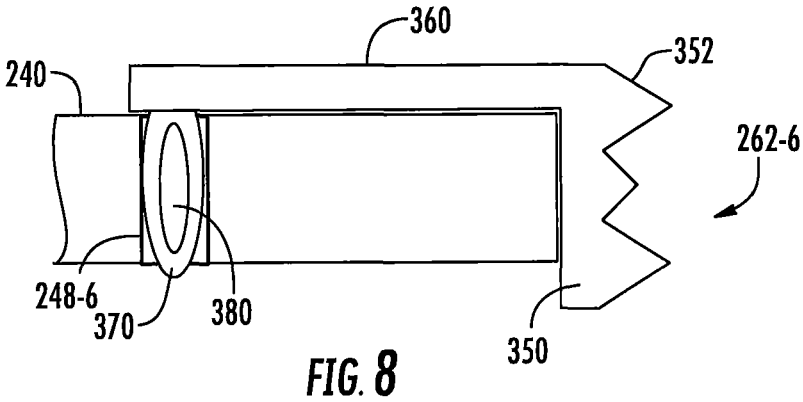
FIG. 8 is a cross-sectional view taken along line 8-8 of FIG. 6.
Figure 9:
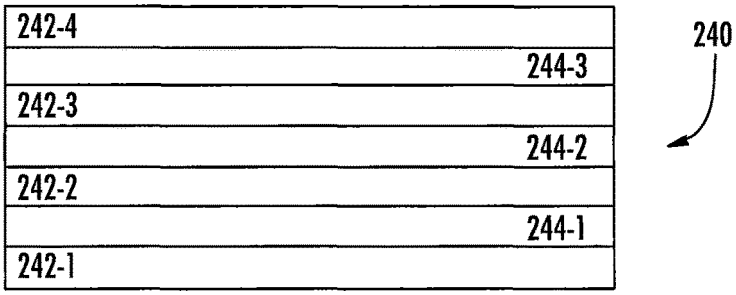
FIG. 9 is a schematic side view of the printed circuit board of FIG. 6 that illustrates the layer construction thereof.
Figure 10:
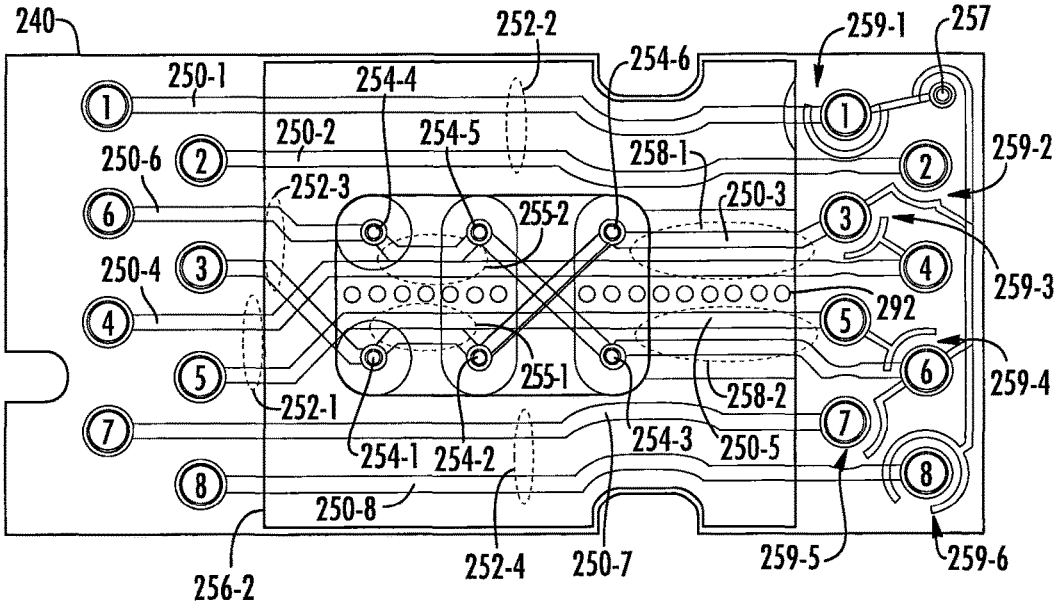
FIG. 10 is a top view of the printed circuit board of FIG. 6.

FIGS. 5-10 illustrate a printed circuit board 240, plug contacts 260 and wire connection terminals 262 that are included in the plug 200. In particular, FIG. 5 is a top perspective view of portions of the plug housing 210 illustrating how the printed circuit board 240 is mounted therein. FIG. 6 is a top perspective view of the printed circuit board 240 illustrating how eight plug blades 260 and eight wire connection terminals 262 are mounted thereon. FIG. 7 is a cross-sectional view taken along line 7-7 of FIG. 6 that illustrates one of the plug blades 260 in greater detail. FIG. 8 is a cross-sectional view taken along line 8-8 of FIG. 6 that illustrates one of the insulation piercing contacts 262 in greater detail. FIG. 9 is a schematic side view of the printed circuit board 240 that illustrates the layer construction thereof. Finally, FIG. 10 is a top view of the printed circuit board 240.

As shown in FIGS. 5 and 6, the printed circuit board 240 is mounted within the housing 210. Eight plug contacts 260-1 through 260-8 and eight wire connection terminals 262-1 through 262-8 are mounted on the printed circuit board 240. As shown in FIGS. 6 and 10, the printed circuit board 240 includes eight metal-plated apertures 246-1 through 246-8 that receive the plug blades 260-1 through 260-8, respectively, and eight metal-plated apertures 248-1 through 248-8 that receive the insulation piercing contacts 262-1 through 262-8, respectively. Each of the apertures 246, 248 extends vertically through the printed circuit board 240. The metal-plated apertures 246-1 through 246-8 and 248-1 through 248-8 are numbered with only the second part of their reference numbers (i.e., 1-8) in FIG. 10 to simplify the drawing. It will be appreciated that the eight apertures labeled 1-8 on the right hand side of the FIG. 10 are apertures 246-1 through 246-8 and that the eight apertures labeled 1-8 on the left hand side of the FIG. 10 are apertures 248-1 through 248-8.

As shown in FIGS. 5 and 6, each plug contact 260-1 through 260-8 is implemented in the form of a low profile plug blade. Each of the eight plug blades 260-1 through 260-8 is mounted adjacent the front edge of the printed circuit board 240 so that top and front edges thereof are exposed through a respective one of the eight longitudinal slots 226 in the housing 210. In the depicted embodiment, a front edge of each plug blade 260 is nearly aligned with the front edge of the printed circuit board 240. In other embodiments, different plug blades may be used such as, for example, plug blades that have vertical extensions that extend along the front edge of the printed circuit board 240.

The plug blades 260-1 through 260-8 are configured to make mechanical and electrical contact with respective contacts, such as, for example, spring jackwire contacts, of a mating communications jack. The plug blades 260-1 through 260-8 may be substantially transversely aligned in a side-by-side relationship. Each of the plug blades 260-1 through 260-8 may comprise a thin (in the transverse direction), longitudinally-extending strip of metal such as copper. The height of each plug blade 260-1 through 260-8 above the top surface of the printed circuit board 240 may be reduced as compared to conventional RJ-45 plug blades. This reduced height may decrease capacitive coupling between adjacent plug blades 260-1 through 260-8.

FIG. 7 is a cross-sectional view taken along line 7-7 of FIG. 6 that illustrates the design of one of the plug blades 260 (namely plug blade 260-8) in greater detail and shows how the plug blade 260-8 is mounted in the printed circuit board 240. The remaining seven plug blades 260-1 through 260-7 may be identical to plug blade 260-8.

As shown in FIG. 7, plug blade 260-8 includes a blade portion 310 that is mounted above the printed circuit board 240 for engaging a contact of a mating jack, and a downwardly-extending projection 320 that is used to mount the plug blade 260-8 within metal-plated aperture 246-8. The projection 320 has a cutout region 330 to form an eye-of-the-needle design so that it may be press-fit into the metal-plated aperture 246-8. In other embodiments, the projection 320 may comprise, for example, a solid post that may be welded or soldered into the metal-plated aperture 246-8. The plug blades 260-1 through 260-8 may be mounted to the printed circuit board 240 in other ways. For example, in other embodiments, elongated contact pads may be provided on the top surface of the printed circuit board 240 and each plug blade 260-1 through 260-8 may be welded or soldered to a respective one of these contact pads. The lower portion of each plug blade 260 may include a recess 340 that further reduces the capacitive coupling between adjacent plug blades 260.

As shown best in FIG. 10, the metal-plated apertures 246-1 through 246-8 that receive the respective plug blades 260-1 through 260-8 are arranged in two transverse rows. Plug blades 260-1, 260-3, 260-5 and 260-7 fit within the metal-plated apertures 246 in the rearward of the two transverse rows. Plug blades 260-2, 260-4, 260-6 and 260-8 are rotated 180 degrees so that their respective downwardly extending projections 320 will be located further forwardly to be aligned with the respective metal-plated apertures 246 in the forward one of the two transverse rows. Arranging the metal-plated apertures 246 in multiple transverse rows may reduce or prevent the possibility of short-circuits developing between adjacent ones of the metal-plated apertures 246 and may also facilitate locating as much of the offending crosstalk as possible close to the plug-jack mating point for each plug blade 260.

The wire connection terminals 262-1 through 262-8 in the form of insulation piercing contacts are mounted adjacent the rear edge of the printed circuit board 240. FIG. 8 is a schematic cross-sectional view taken along lines 8-8 of FIG. 6 that illustrates insulation piercing contact 262-6 in greater detail and how it is mounted on the printed circuit board 240.

As shown in FIG. 8, the insulation piercing contact 262-6 includes an insulation piercing portion 350 that has a plurality of insulation cutting blades 352 that may pierce the insulation of an insulated conductor 130 of cable 110 that is pressed against the blades 352 in order to make physical and electrical contact with the metal core of the insulated conductor 130. The insulation piercing contact 262-6 is mounted on the printed circuit board 240 so that the insulation piercing portion 350 is mounted to extend vertically just rearward of the rear edge of the printed circuit board 240. The insulation piercing portion 350 includes three insulation cutting blades 352 that extend longitudinally therefrom. The insulation piercing contact 262-6 further includes an extension 360 and a termination post 370. The termination post 370 has a cutout region 380 so that the termination post 370 has an eye-of-the-needle design so that it may be press-fit into a metal-plated aperture 248-6 in the printed circuit board 240. In other embodiments, the termination post 370 may comprise, for example, a solid post that may be welded or soldered into the metal-plated aperture 248-6. The extension 360 connects the insulation piercing portion 350 to the termination post 370. The extension 360 extends longitudinally just above the top surface of the printed circuit board 240.

In the depicted embodiment, the extensions 360 for four of the insulation piercing contacts (namely insulation piercing contacts 262-3 and 262-6 through 262-8) are positioned above the top surface of printed circuit board 240, while the extensions 360 for the other four insulation piercing contacts (namely insulation piercing contacts 262-1, 262-2, 262-4 and 262-5) are positioned below the bottom surface of printed circuit board 240. As will be discussed in greater detail below, this may reduce the amount of offending crosstalk that is generated in the rear portion of plug 200.

FIGS. 9 and 10 illustrate the construction of the printed circuit board 240 in greater detail. In particular, FIG. 9 is a schematic side view of the printed circuit board 240 that illustrates the layer construction thereof, and FIG. 10 is a top view of the printed circuit board 240 that illustrates the various conductive structures included on each layer of the printed circuit board 240.

The printed circuit board 240 comprises a multi-layered rigid structure having a plurality of conductive layers and a plurality of dielectric layers that are sequentially stacked. As shown in FIG. 9, in the depicted embodiment, the printed circuit board 240 includes four conductive layers 242-1 through 242-4 that are separated from each other by three dielectric layers 244-1 through 244-3. Dielectric material (not shown) may also be provided on the exposed bottom portion of the lowermost conductive layer 242-1 and on the exposed top portion of the uppermost conductive layer 242-4 to protect and insulate those layers. It will be appreciated that in other embodiments a flexible printed circuit board or a printed circuit board that includes both flexible and rigid portions may be used in place of the rigid printed circuit board 240 depicted in the figures.

Referring now to FIG. 10, a plurality of conductive paths 250-1 through 250-8 electrically connect metal-plated apertures 246-1 through 246-8 to metal-plated apertures 248-1 through 248-8, respectively. Conductive paths 250-1, 250-2, 250-7 and 250-8 each comprise a respective conductive trace that is part of conductive layer 242-4. Conductive paths 250-4 and 250-5 each comprise a respective conductive trace that is part of conductive layer 242-1. Conductive paths 250-3 and 250-6 each comprise one or more conductive traces that are formed on each of conductive layers 242-1, 242-3 and 242-4 as well as conductive vias 254 that extend vertically through the printed circuit board 240 to electrically connect conductive traces on different layers 242. The eight conductive paths 250-1 through 250-8 may comprise four differential pairs of conductive paths 252-1 through 252-4, each of which is configured to carry a differential signal. In particular, conductive paths 250-4 and 250-5 may form the first differential pair 252-1, conductive paths 250-1 and 250-2 may form the second differential pair 252-2, conductive paths 250-3 and 250-6 may form the third differential pair 252-3, and conductive paths 250-7 and 250-8 may form the fourth differential pair 252-4.

A variety of crosstalk generating structures are also included on the printed circuit board 240. Crosstalk arises between the differential pairs in the industry standardized RJ-45 plug jack interface due to the unequal coupling that occurs between the differential pairs in the plug jack mating region of the plug contacts. This crosstalk is conventionally referred to as "offending" crosstalk as it is unwanted coupling that necessarily arises because of the arrangement of the contacts in the interface specification. In order to reduce the impact of this offending crosstalk, communications jacks were developed that included circuits that introduced so-called "compensating" crosstalk that was used to cancel much of the offending crosstalk that was being introduced in the plug jack mating region.

In particular, in order to cancel the offending crosstalk that is generated in a plug jack connector because a first conductor of a first differential pair inductively and/or capacitively couples more heavily with a first of the two conductors of a second differential pair than does the second conductor of the first differential pair (which necessarily occurs because the plug blades are aligned in a row), jacks were designed so that the second conductor of the first differential pair would capacitively and/or inductively couple with the first of the two conductors of the second differential pair later in the jack to provide a "compensating" crosstalk signal. As the first and second conductors of the differential pair carry equal magnitude, but opposite phase signals, so long as the magnitude of the "compensating" crosstalk signal is equal to the magnitude of the "offending" crosstalk signal, then the compensating crosstalk signal that is introduced later in the jack may substantially cancel out the offending crosstalk signal.

In order to ensure that jacks manufactured by one vendor will have compensating crosstalk levels that will cancel out the offending crosstalk in a plug manufactured by another vendor, the industry standards now specify amounts of offending crosstalk that must be generated between the various differential pair combinations in an RJ-45 plug for that plug to be industry-standards compliant. The communications jacks are then designed to inject appropriate amounts of compensating crosstalk that cancels out the offending crosstalk that is generated in the communications plug.

While the above-described crosstalk compensation techniques may work well with signals having frequencies of, for example, about 100 MHz or less, they do not work as well with higher frequency signals. The problem is that the locations where the offending crosstalk and the compensating crosstalk are injected generally are spaced apart from each other, and hence the phase of the signals carried on the conductors will vary as the signals move between the locations where the offending and compensating crosstalk signals are injected. With higher frequency signals, the phase of the signal changes more quickly, and hence the phase of the compensating crosstalk signal will not be exactly opposite (i.e., 180 degrees) the offending crosstalk signal, and therefore will not fully cancel the offending crosstalk signal, leaving residual "uncompensated" crosstalk. The effect of such delays and phase shifts on crosstalk compensation in communications connectors is explained in U.S. Pat. No. 5,997,358 to Adriaenssens et al.

One way of reducing the amount of uncompensated crosstalk is to reduce the distance, and hence the delay, between the locations where the offending crosstalk and the compensating crosstalk are injected. As discussed above, RJ-45 communications plugs are required to have certain levels of offending crosstalk which are then cancelled by crosstalk compensation circuits in a mating jack. In order to make this cancellation more effective, one strategy is to reduce or minimize the amount of offending crosstalk that arises in the back end of the plug so that almost all of the offending crosstalk is injected very close to the plug jack mating point, so that it will be closer to the compensating crosstalk circuits in the jack. As discussed below, the communications plugs according to embodiments of the present invention may have a number of crosstalk circuits (both offending and compensating) that reduce the amount of uncompensated offending crosstalk that is present in the rear portion of the plug so that almost all of the offending crosstalk will be injected in the front portion of the plug, very close to the plug jack mating point.

For example, as shown in FIG. 10, each of the internal conductive layers 242-2, 242-3 of the printed circuit board 240 includes a conductive image plane 256-1, 256-2 (only image plane 256-2 is visible in FIG. 10; image plane 256-1 may be identical to image plane 256-2). Each conductive image plane 256 may be implemented as a thin layer of metal having openings therein for the conductive vias 254. The conductive image planes 256 may reduce crosstalk between the differential pairs 252 of conductive paths 250, particularly with respect to differential pairs 252 of conductive paths 250 that are on conductive layers 242 of the printed circuit board 240 that have the conductive image plane 256 interposed therebetween. The conductive image planes 256 may be electrically floating layers (i.e., they are not electrically connected to a ground voltage or other reference voltage) in some embodiments.

As another example, conductive paths 250-3 and 250-6 have a "crossover" and inductively coupling sections that are designed to reduce the amount of uncompensated offending crosstalk that is present in the back-end of the plug 200. In particular, conductive path 250-3 includes a first conductive trace in conductive layer 242-3 that extends from metal-plated aperture 248-3 to a conductive via 254-1, a second conductive trace in conductive layer 242-3 that extends from conductive via 254-1 to a conductive via 254-2, a third conductive trace in conductive layer 242-1 that extends from conductive via 254-2 to a conductive via 254-6, and a fourth conductive trace in conductive layer 242-1 that extends from conductive via 254-6 to metal-plated aperture 246-3. Conductive path 250-6 includes a first conductive trace in conductive layer 242-4 that extends from metal-plated aperture 248-6 to a conductive via 254-4, a second conductive trace in conductive layer 242-3 that extends from conductive via 254-4 to a conductive via 254-5, a third conductive trace in conductive layer 242-4 that extends from conductive via 254-5 to conductive via 254-3, and a fourth conductive trace in conductive layer 242-1 that extends from conductive via 254-3 to metal-plated aperture 246-6.

The conductive vias 254 that are used to transition conductive paths 250-3 and 250-6 between different of the conductive layers 242 allow the conductive paths 250-3 and 250-6 to cross over or under conductive paths 250-4 and 250-5 and each other. This "crossover" allows conductive path 250-3 to be routed directly adjacent to conductive path 250-5 near the center of the printed circuit board 240 to form a compensating crosstalk circuit 255-1 (which inductively couples compensating crosstalk between pairs 1 and 3) and to be routed directly adjacent to conductive path 250-4 near the front of the printed circuit board 240 to form an offending crosstalk circuit 258-1 (which inductively couples offending crosstalk between pairs 1 and 3). Likewise, the crossover allows conductive path 250-6 to be routed directly adjacent to conductive path 250-4 near the center of the printed circuit board 240 to form a compensating crosstalk circuit 255-2 (which inductively couples compensating crosstalk between pairs 1 and 3) and to be routed directly adjacent to conductive path 250-5 near the front of the printed circuit board 240 to form an offending crosstalk circuit 258-2 (which inductively couples offending crosstalk between pairs 1 and 3).

The compensating crosstalk circuits 255-1 and 255-2 may be used to cancel offending crosstalk between pairs 1 and 3 that is generated in the back end of the plug 200 and to also at least partially compensate the offending crosstalk that is generated in offending crosstalk circuits 258-1 and 258-2. As a result, the back end of plug 200 may have very little uncompensated crosstalk between pairs 1 and 3, and hence almost all of the offending crosstalk between pairs 1 and 3 that is mandated by the industry standards may be injected in the front of plug 200, very close to the plug jack mating points for plug blades 260-3 through 260-6.

The printed circuit board 240 also includes other crosstalk reduction features. For example, conductive paths 250-1 and 250-2 (differential pair 252-2) are formed solely on the uppermost conductive layer 242-4 of printed circuit board 240, while the next closest conductive paths (i.e., conductive paths 250-3 and 250-6) are mostly routed on the lowermost conductive layer 242-1 of printed circuit board 240. The increased distance between these conductive paths (due to the vertical separation) combined with the ability of the conductive image planes 256 to reduce coupling between conductive layers 242 may significantly reduce the coupling (crosstalk) between the conductive paths of differential pair 252-2 and the conductive paths of differential pair 252-3. Similarly, conductive paths 250-7 and 250-8 (differential pair 252-4) are formed solely on the uppermost conductive layer 242-4 of printed circuit board 240, while the next closest conductive paths (i.e., conductive paths 250-3, 250-5 and 250-6) are routed solely on the lowermost conductive layer 242-1 of printed circuit board 240 in regions where they come close to conductive paths 250-7 and 250-8 in order to further reduce crosstalk.

Additionally, a plurality of crosstalk compensation circuits may also be provided on printed circuit board 240 adjacent the metal-plated apertures 248. These crosstalk compensation circuits are typically implemented as capacitors between various of the metal-plated apertures 248, and are not shown in FIG. 10 to simplify the drawing. These additional crosstalk compensation circuits may be sized to cancel much or all of the crosstalk generated in the wire connection region of the plug 200 where the insulated conductors 130 of a communications cable 110 are terminated into respective ones of the insulation piercing contacts 262.

A plurality of capacitive offending crosstalk circuits 259-1 through 259-6 are also included on the printed circuit board 240. As noted above, the plug blades 260-1 through 260-8 may have a reduced height as compared to conventional plug blades, and hence they may inject less than the industry standardized amounts of offending crosstalk between the four differential pairs 252-1 through 252-4. As discussed above, the plug 200 also includes various crosstalk compensation circuits that are designed to reduce the amount of offending crosstalk generated in other portions of the plug 200. Accordingly, in order to ensure that the plug 200 injects the industry-standardized amounts of offending crosstalk between the four differential pairs 252-1 through 252-4, six capacitive offending crosstalk circuits 259-1 through 259-6 are provided on the printed circuit board 240 adjacent the plug blades 240. These offending crosstalk circuits 259-1 through 259-6 are used to inject additional offending crosstalk between the pairs in order to bring the RJ-45 plug 200 into compliance with these industry standards.

The above-described approach may be beneficial because, as discussed above, more effective crosstalk cancellation may generally be achieved the closer the point of injection of the compensating crosstalk (or at least the first stage of compensating crosstalk) is to the point where the offending crosstalk is injected. The RJ-45 plug 200 is designed to generate low levels of offending crosstalk in the back portion of the plug (i.e., in portions of the plug 200 that are at longer electrical delays from the plug-jack mating regions of the plug blades 260-1 through 260-8). Moreover, the offending crosstalk circuits 259-1 through 259-6 that are used to generate much of the offending crosstalk may be located at very short delays from the plug jack mating regions of the plug blades 26Q-1 through 260-8. As a result, the average amount of delay between the offending crosstalk in the plug 200 and the compensating crosstalk circuits in a mating jack may be reduced, which may allow for more effective cancellation of the offending crosstalk in a mating jack.

As shown in FIG. 10, the first capacitive offending crosstalk circuit 259-1 is formed between metal-plated aperture 246-1 and a conductive trace that extends from metal-plated aperture 246-6. The second capacitive offending crosstalk circuit 259-2 is formed between metal-plated aperture 246-2 and a conductive trace that extends from metal-plated aperture 246-3. The third capacitive crosstalk compensation circuit 259-3 is formed between metal-plated aperture 246-3 and a conductive trace that extends from metal-plated aperture 246-4. The fourth capacitive crosstalk compensation circuit 259-4 is formed between metal-plated aperture 246-6 and a conductive trace that extends from metal-plated aperture 246-5. The fifth capacitive crosstalk compensation circuit 259-6 is formed between metal-plated aperture 246-7 and a conductive trace that extends from metal-plated aperture 246-6. The sixth capacitive crosstalk compensation circuit 259-3 is formed between metal-plated aperture 246-8 and a conductive trace that extends from metal-plated aperture 246-3. A conductive via 257 is also provided that is connected to metal-plated aperture 246-1, and the conductive trace that extends from metal-plated aperture 246-6 to metal-plated aperture 246-1 wraps around the conductive via 257 to increase the amount of offending crosstalk generated by the first offending crosstalk circuit 259-1. As can be seen with reference to FIG. 10, each of the six offending crosstalk capacitors 259-1 through 259-6 is configured to inject offending crosstalk at a location that is very near the plug-jack mating region of each plug blade 260-1 through 260-8.

Figure 11:
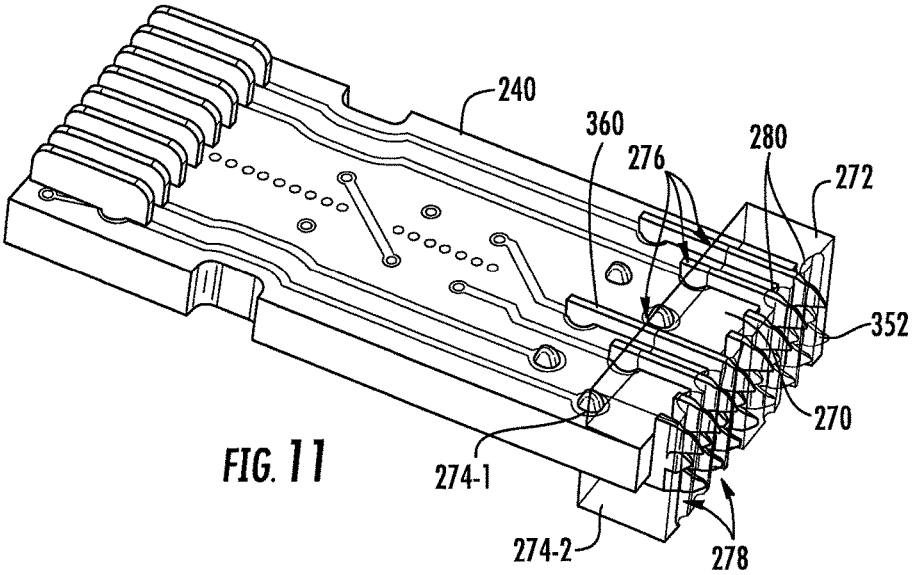
FIG. 11 is top perspective view of the printed circuit board, plug blades and wire connection terminals of FIG. 6 that further illustrates a dielectric contact holder (shown in phantom view) that is mounted on the rear edge of the printed circuit board.
Figure 12:
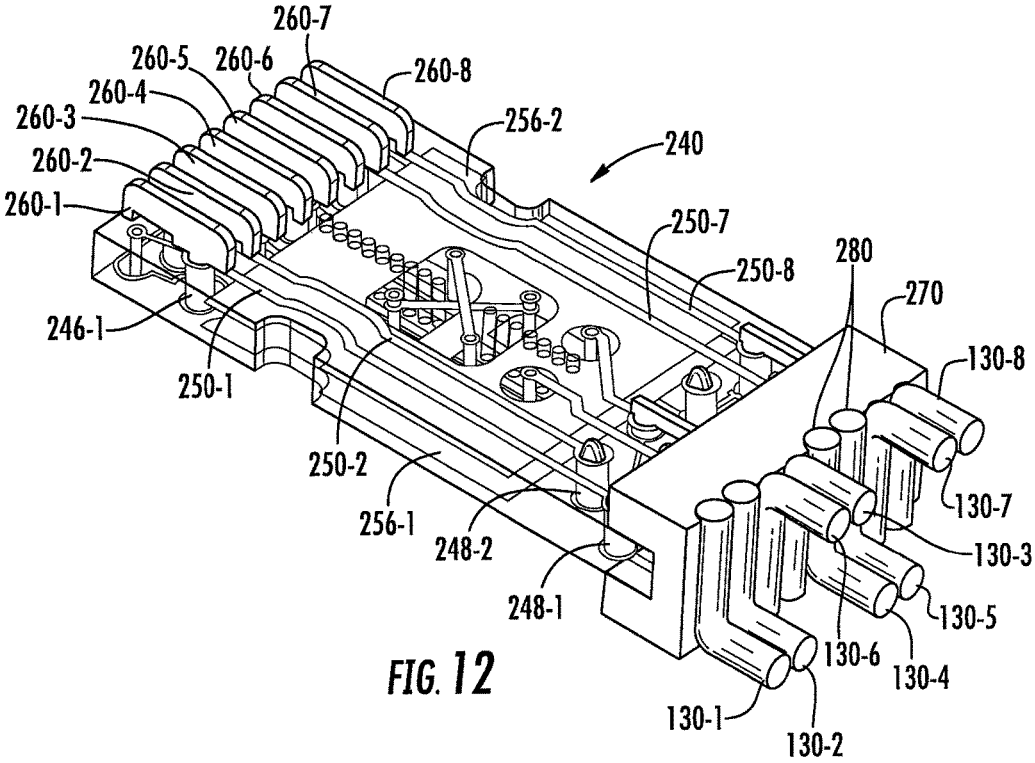
FIG. 12 is another top perspective view of the printed circuit board, plug blades, wire connection terminals and contact holder of FIG. 11 that illustrates how the eight conductors of a communications cable are mounted within the contact holder.

FIGS. 11-12 are perspective views of the printed circuit board 240 that illustrate how a dielectric contact holder 270 is mounted thereon to support the insulation piercing contacts 262. In particular, FIG. 11 illustrates the dielectric contact holder 270 in phantom view to illustrate how it attaches to the printed circuit board 240 to support the insulation piercing contacts 262, and FIG. 12 shows how the dielectric contact holder 270 facilitates terminating the eight conductors 130 of communications cable 110 onto respective insulation piercing contacts 262.

As shown in FIGS. 11 and 12, the contact holder 270 comprises a base 272 and upper and lower shelves 274-1, 274-2 that extend forwardly from the base 272. The rear end of the printed circuit board 240 is captured between the upper and lower shelves 274-1, 274-2. The base 272 may be sized to fit snugly within the interior of the housing 210, and thus the contact holder 270 may be used to mount the rear end of the printed circuit board 240 within the housing 210. As can be seen in the phantom view of FIG. 11, the upper shelf 274-1 has four longitudinal slots 276 that receive the respective extensions 360 of the insulation piercing contacts 262 that are mounted on the top surface of the printed circuit board 240. While not visible in the drawings, the lower shelf 274-2 likewise has four longitudinal slots 276 that receive the respective extensions 360 of the insulation piercing contacts 262 that are mounted on the bottom surface of the printed circuit board 240.

The base 272 of contact holder extends vertically along the rear edge of printed circuit board 240, while the upper and lower shelves 274-1, 274-2 extend laterally therefrom toward the front of the printed circuit board 240. The base includes eight vertically extending slots 278 that receive the insulation piercing portions 350 of the eight insulation piercing contacts 262 so that the blades 352 are exposed. Eight vertically-extending semicircular channels 280 are formed into the rear surface of the base 272 that are each sized to receive a respective one of the insulated conductors 130 of communications cable 110. The channels 280 may align the insulated conductors 130 of communications cable 110 with the blade portions 350 of the respective insulation piercing contacts 262 so that the insulation piercing contacts 262 may slit the insulation of the respective conductors 130 and make physical and electrical contact with the wires therein. The base 272 of the contact holder 270 may provide physical support to the eight insulation piercing contacts 262 and may help hold each insulation piercing contact 262 in its proper position to facilitate terminating the insulated conductors 130 of communications cable 110 into the respective insulation piercing contacts 262.

Figure 13:
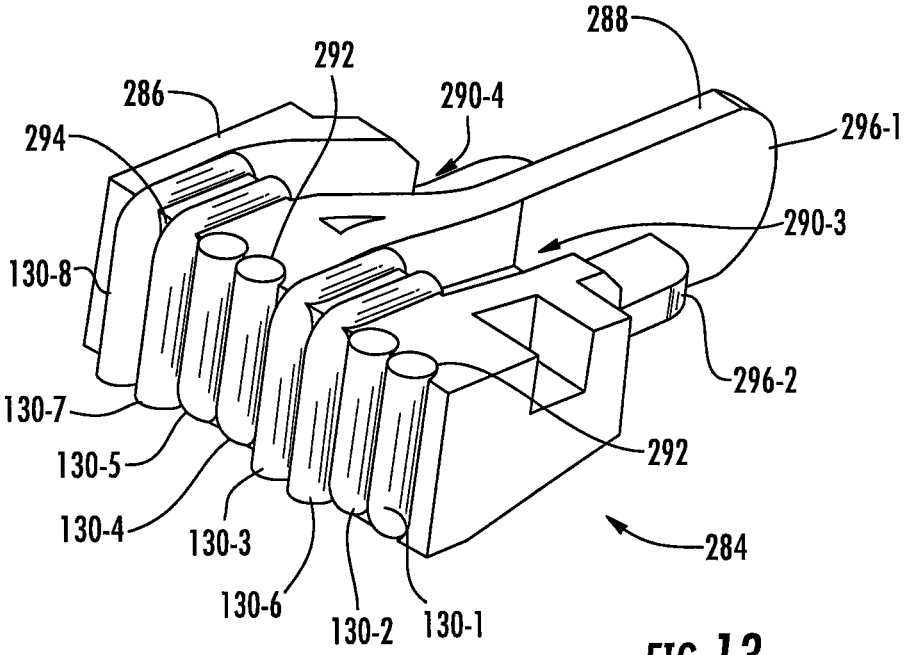
FIG. 13 is a top perspective view of a wire guide that is used to terminate a communications cable into the plug of FIG. 4.
Figure 14:
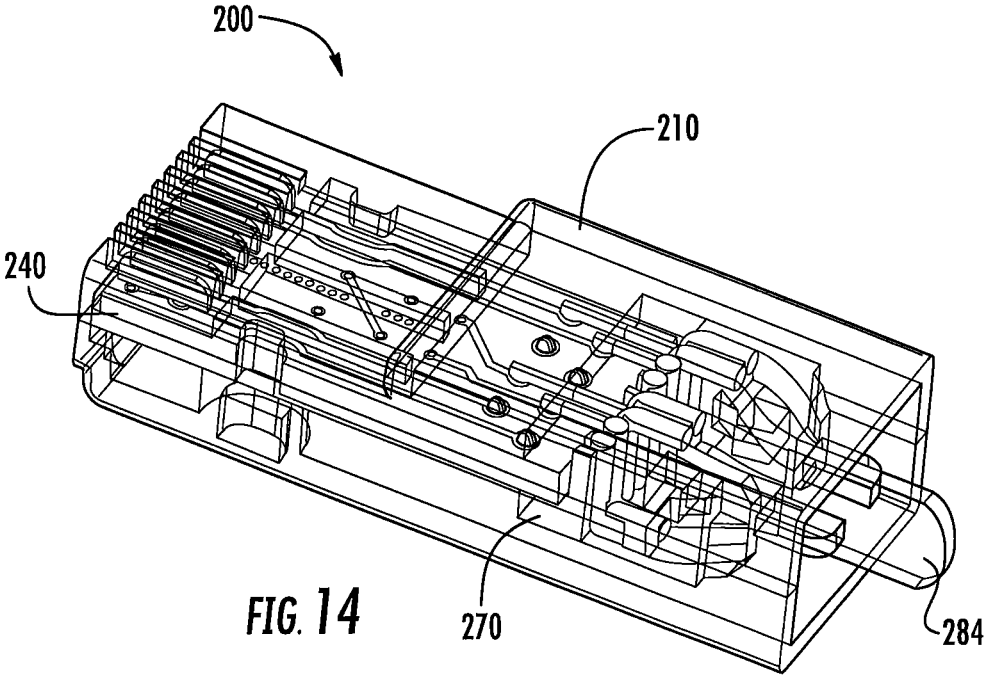
FIG. 14 is a top perspective view illustrating the printed circuit board of FIG. 6 mounted in the plug housing with the wire guide of FIG. 13 inserted into the plug housing.

FIGS. 13-14 illustrate a wire guide 284 of the plug 200 and how it may be used to terminate a communications cable into the plug 200 in the field. In particular, FIG. 13 is a top perspective view of the wire guide 284 that illustrates how the end portions of the eight insulated conductors 130 of communications cable 110 may be mounted thereon for quick and easy termination into the plug 200, and FIG. 14 is a top perspective view illustrating the printed circuit board of FIG. 6 mounted in the plug housing 210 with the wire guide 284 of FIG. 13 mounted thereon.

As shown in FIG. 13, the wire guide 284 includes a base 286 and a crosstail 288. The base 286 has first through fourth channels 290-1 through 290-4 formed therein that each receive a respective one of the differential pairs 140-1 through 140-4 of conductors 130 (only channels 290-3 and 290-4 are visible in FIG. 13). Differential pairs 140-1 and 140-2 are received in the respective channels 290-1 and 290-2 that are formed in the lower surface of the base 286, while differential pairs 140-3 and 140-4 are received in the respective channels 290-3 and 290-4 that are formed in the upper surface of the base 286. The insulated conductors 130 of each differential pair 140 extend side-by-side in their respective channels 290.

The arrangement in which two of the differential pairs 140 of insulated conductors 130 extend along the upper surface of the base 286 and the other two differential pairs 140 extend along the bottom of the base 286 allows the conductors 130 of different differential pairs 140 to be spaced apart a greater distance along the transverse dimension and provides additional separation in the vertical dimension. The larger separations in the transverse and vertical dimensions reduce crosstalk between the differential pairs 140.

The wire guide 284 also includes eight vertically-extending semicircular channels 292 that are formed in the front surface of the base 286. Each of the semicircular channels 292 is sized to receive a respective one of the insulated conductors 130 of communications cable 110. The forward portion of each channel 290 includes a wire separator 294 that splits the conductors 130 of each differential pair 140. The forward portion of each wire separator 294 may be enlarged slightly to more firmly hold each conductor 130 at the point where the conductor 130 goes through a 90 degree bend as the conductors 130 are routed into their respective vertically-extending semicircular channels 292.

The crosstail 288 extends rearwardly from the base 286. The crosstail 288 includes a vertical member 296-1 and a horizontal member 296-2. The crosstail 288 is inserted within the jacket 120 of the communications cable 110 and separates the four differential pairs 140 of insulated conductors 130 from each other in the end portion of the cable 110. The crosstail 288 may provide structural members that a strain relief ring (not shown) may crimp against in order to provide strain relief so that the cable 110 cannot easily be pulled out of the plug housing 210.

In order to terminate the communications cable 110 into plug 200, the cable 110 is inserted through the cable aperture 232 of the rear cap 230 and the rear cap 230 is then slid down the cable 110 and out of the way. An end portion of the cable jacket 120 is removed during assembly so that the insulated conductors 130-1 through 130-8 extend forwardly beyond the end of the cable jacket 120. A technician then routes each differential pair 140 of insulated conductors 130 into a corresponding one of the channels 290 in wire guide 284. The insulated conductors 130 are routed through the channels 290 so that the end portions thereof can be bent either upwardly or downwardly into a respective one of the semicircular channels 292. The ends of insulated conductors 130-1, 130-2, 130-4 and 130-5 may be trimmed such that they are approximately coplanar with the upper surface of the base 286, while the ends of insulated conductors 130-3, 130-6, 130-7 and 130-8 may also be trimmed such that they are approximately coplanar with the lower surface of the base 286. As a result, the vertically-extending end portions of the insulated conductors 130 may all have approximately the same length, and the eight insulated conductors 130 are mounted on the wire guide 284 so that their end portions are arranged in a transverse row, as shown in FIG. 13.

Once the insulated conductors 130 of a communications cable 110 are mounted in the wire guide 284 in the manner shown in FIG. 13, a technician may terminate the communications cable 110 into plug 200 simply by inserting the wire guide 284 into the rear opening 218 of housing 210 and then forcing the wire guide 284 forward until the exposed vertically-extending end portions of the eight conductors 130 are received within the vertically extending semicircular channels 280 on the rear surface of the base 272 of contact holder 270. The vertically extending channels 280 may be aligned with respective ones of the vertically extending channels 292 so that together each pair of channels 280, 292 may together comprise a circular channel that substantially surrounds the vertically-extending end portion of a respective one of the insulated conductors 130. The eight insulating piercing contacts 262 extend into these circular channels through the respective slots 278 and puncture the insulation of the respective conductors 130 to make mechanical and electrical connections therewith. Thus, by simply mounting the conductors 130 on the wire guide 284 and then pressing the wire guide 284 against the contact holder 270 the cable 110 may be terminated into plug 200. The plug housing 210 may have retention features (not shown) such as snap clips that hold the wire guide 284 firmly in place against the contact holder 270 once the wire guide 284 has been full inserted into the housing 210. Alternatively, the retention features may hold the rear cap 230 in place within the rear opening, and the rear cap 230 may hold the wire guide 284 firmly in place against the contact holder 270.

The present invention is not limited to the illustrated embodiments discussed above; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "top," "bottom," "side," "upper," "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the term "signal current carrying path" is used to refer to a current carrying path on which an information signal will travel on its way from the input to the output of a communications plug. Signal current carrying paths may be formed by cascading one or more conductive traces on a wiring board, metal-filled apertures that physically and electrically connect conductive traces on different layers of a printed circuit board, portions of plug blades, conductive pads, and/or various other electrically conductive components over which an information signal may be transmitted. Branches that extend from a signal current carrying path and then dead end such as, for example, a branch from the signal current carrying path that forms one of the electrodes of an inter-digitated finger or plate capacitor, are not considered part of the signal current carrying path, even though these branches are electrically connected to the signal current carrying path. While a small amount of current will flow into such dead end branches, the current that flows into these dead end branches generally does not flow to the output of the plug that corresponds to the input of the plug that receives the input information signal.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

All of the above-described embodiments may be combined in any way to provide a plurality of additional embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An insulation piercing contact, comprising:

an insulation piercing portion that extends in a first direction and that has at least a first cutting blade that extends in a second direction;

a termination post that extends in the first direction; and a longitudinal extension that extends in the second direction that connects the insulation piercing portion to the termination post.

2. The insulation piercing contact of claim 1, where the second direction is substantially perpendicular to the first direction.

3. The insulation piercing contact of claim 1, wherein the termination post comprises an eye-of-the-needle termination.

4. The insulation piercing contact of claim 1, in combination with a printed circuit board having a top face, a bottom face, a front edge and a rear edge, wherein the insulation piercing portion of the insulation piercing contact is mounted to extend rearwardly from the rear edge of the printed circuit board.

5. The insulation piercing contact of claim 1, wherein the termination post extends downwardly from a first end portion of the longitudinal extension and the insulation piercing portion extends downwardly from a second end portion of the longitudinal extension.

6. The insulation piercing contact of claim 1, wherein the insulation piercing portion is a first insulation piercing portion, the termination post is a first termination post and the longitudinal extension is a first longitudinal extension, the insulation piercing contact in combination with a second insulation piercing contact that has:

a second insulation piercing portion that extends in the first direction;

a second termination post that extends in the first direction; and a second longitudinal extension that extends in the second direction that connects the second insulation piercing portion to the second termination post, wherein the second longitudinal extension is longer than the first longitudinal extension.

7. A method of terminating a communications cable into a communications plug, the method comprising:

mounting first through eighth wire connection terminals on a rear portion of a printed circuit board;

mounting a dielectric contact holder on the circuit board, the dielectric contact holder at least partially surrounding the wire connection terminals;

mounting the printed circuit board and the dielectric contact holder within a housing of the communications plug;

terminating first through eighth insulated conductors of the communications cable into a wire guide; and then inserting the wire guide into the housing to terminate the first through eighth insulated conductors into the respective first through eighth wire connection terminals, wherein the first through eighth wire connection terminals extend rearwardly of a rear edge of the printed circuit board.

8. The method of claim 7, wherein the first through eighth insulated conductors are captured between the dielectric contact holder and the wire guide.

9. The method of claim 7, further comprising inserting a rear cap into the plug housing, wherein the wire guide is captured between the printed circuit board and the rear cap.

10. An insulation piercing contact, comprising:

a termination post that is configured to be mounted in an aperture in a top surface of a printed circuit board;

an insulation piercing portion that is configured to extend rearwardly from a rear end of the printed circuit board when the termination post is mounted in the aperture in the printed circuit board, the insulation piercing portion including at least a first cutting blade; and a longitudinal extension that extends between the insulation piercing portion and the termination post.

11. The insulation piercing contact of claim 10, wherein the longitudinal extension is configured to extend from the aperture in the printed circuit board to the rear end of the printed circuit board.

12. The insulation piercing contact of claim 10, wherein the termination post extends in a first direction and the longitudinal extension extends in a second direction that is perpendicular to the first direction.

13. The insulation piercing contact of claim 10, wherein the insulation piercing portion extends in a first direction and the longitudinal extension extends in a second direction that is perpendicular to the first direction.

14. The insulation piercing contact of claim 13, wherein the first cutting blade extends in the first direction.

15. The insulation piercing contact of claim 10, wherein the insulation piercing portion is a first insulation piercing portion, the termination post is a first termination post and the longitudinal extension is a first longitudinal extension, the insulation piercing contact in combination with a second insulation piercing contact that has:

a second termination post that is configured to be mounted in a second aperture in the top surface of the printed circuit board;

a second insulation piercing portion that is configured to extend rearwardly from the rear end of the printed circuit board when the second termination post is mounted in the second aperture in the printed circuit board, the second insulation piercing portion including at least a second cutting blade; and a second longitudinal extension that extends between the second insulation piercing portion and the second termination post, wherein the second longitudinal extension is longer than the first longitudinal extension.

16. The insulation piercing contact of claim 10, wherein the longitudinal extension extends along a major surface of the printed circuit board.

17. The method of claim 7, wherein the wire guide is separate from the dielectric contact holder.

18. A method of terminating a communications cable into a communications plug, the method comprising:

mounting first through eighth wire connection terminals on a rear portion of a printed circuit board so that the first through eighth wire connection terminals extend rearwardly of a rear edge of the printed circuit board;

mounting first through eight plug blades on a forward portion of the printed circuit board;

mounting the printed circuit board within a housing of the communications plug;

terminating first through eighth insulated conductors of the communications cable into a wire guide; and then inserting the wire guide into the housing to terminate the first through eighth insulated conductors into the respective first through eighth wire connection terminals.

* * * * *